US007686596B2

(12) United States Patent
Clausen et al.

(10) Patent No.: US 7,686,596 B2
(45) Date of Patent: Mar. 30, 2010

(54) HYDRAULIC PRESSURE AMPLIFIER

(75) Inventors: Peter J. M. Clausen, Nordborg (DK); Leif Hansen, Soenderborg (DK); Thyge Bollmann, Augustenborg (DK); Christen Espersen, Augustenborg (DK)

(73) Assignee: miniBOOSTER HYDRAULICS A/S, Soenderborg (DK)

( * ) Notice: Subject to any disclaimer, the term of this patent is extended or adjusted under 35 U.S.C. 154(b) by 16 days.

(21) Appl. No.: 11/809,347

(22) Filed: May 31, 2007

(65) Prior Publication Data

US 2008/0008601 A1 Jan. 10, 2008

(30) Foreign Application Priority Data

Jun. 2, 2006 (DE) ..... 10 2006 026 337

(51) Int. Cl.
*F04B 35/04* (2006.01)

(52) U.S. Cl. ..... 417/415; 60/560

(58) Field of Classification Search ..... 267/118, 267/119, 130; 417/403, 415; 91/305, 450; 60/540, 560, 593
See application file for complete search history.

(56) References Cited

U.S. PATENT DOCUMENTS

| | | | | |
|---|---|---|---|---|
| 3,054,261 | A * | 9/1962 | Marette et al. | 60/418 |
| 3,174,285 | A * | 3/1965 | Stelzer | 60/549 |
| 3,548,866 | A * | 12/1970 | Kasuba et al. | 137/487.5 |
| 4,029,440 | A * | 6/1977 | Olsen | 417/403 |
| 4,366,673 | A * | 1/1983 | Lapp | 60/477 |
| 4,671,063 | A * | 6/1987 | Anaker | 60/458 |
| 2005/0178121 | A1 * | 8/2005 | Hansen et al. | 60/560 |
| 2006/0073037 | A1 * | 4/2006 | Pedersen et al. | 417/415 |

FOREIGN PATENT DOCUMENTS

| | | |
|---|---|---|
| DE | 1 426 580 | 8/1969 |
| DE | 33 07 930 | 9/1984 |
| DE | 36 21 492 | 1/1987 |
| DE | 42 39 362 | 5/1994 |
| DE | 103 93 780 | 10/2005 |

OTHER PUBLICATIONS

Bosch Rexroth AG, Verschlussstopfen, Stutzen Und Tüllen.

* cited by examiner

*Primary Examiner*—Christopher P Schwartz
(74) *Attorney, Agent, or Firm*—Friedrich Kueffner

(57) ABSTRACT

A hydraulic pressure amplifier with a housing which has an end face at a low pressure side and an end face at a high pressure side and a circumferential wall between the two end faces, wherein an outlet valve is arranged adjacent the end face on the high pressure side, and an outlet duct for the hydraulic liquid which is under high pressure. In a pressure amplifier of the above-described type, the outlet duct opens into the circumferential wall or extends through a connection plug which is screwed into the end face on the high pressure side and closes off an assembly duct which receives the outlet valve.

12 Claims, 2 Drawing Sheets

HYDRAULIC PRESSURE AMPLIFIER

BACKGROUND OF THE INVENTION

1. Field of the Invention

The present invention relates to a hydraulic pressure amplifier with a housing which has an end face at a low pressure side and an end face at a high pressure side and a circumferential wall between the two end faces, wherein an outlet valve is arranged adjacent the end face on the high pressure side, and an outlet duct for the hydraulic liquid which is under high pressure.

2. Description of the Related Art

A pressure amplifier of the above-described type is known, for example, as pressure amplifier HC8 of miniBOOSTER HYDRAULICS A/S, Soenderborg, Denmark.

A pressure amplifier of this type frequently is composed of a lower part with hydraulic connections through which the hydraulic liquid is supplied, an intermediate part and an upper part, wherein the upper part has an outlet at an end face thereof for the hydraulic liquid, wherein the hydraulic liquid has then been placed under high pressure. A capsule which at least partially surrounds the upper part is additionally mounted on the upper part. The outlet duct is arranged in the capsule. The capsule is sealed off from the upper part, for example, with a silver seal, so that the hydraulic liquid which is under high pressure can be transferred without losses from the upper part into the capsule.

Arranged in the upper part is an outlet valve whose diameter is significantly greater than the diameter of the outlet duct. The outlet duct may have a diameter of about 2 to 3 mm, while the outlet valve has a diameter of 10 mm. The capsule has the purpose of once again reversing the diameter expansion necessary for assembling the outlet valve, so that a normal high pressure fitting can be mounted which can interact with the small diameter of the outlet duct.

This type of pressure amplifier operates very reliably. The pressure amplifier has been found useful. However, the pressure amplifier is relatively heavy and requires a certain structural space.

In accordance with an alternative solution, in which a cover plate is used instead of a capsule, the end face of the upper part is sealed off. The connection geometry for the high pressure fitting and the appropriate outlet duct are provided in the cover plate. This type of pressure amplifier is also large and heavy.

SUMMARY OF THE INVENTION

It is the object of the present invention to provide a pressure amplifier which is of lighter and more compact construction.

In accordance with the present invention, in a pressure amplifier of the above-described type, the outlet duct opens into the circumferential wall or extends through a connection plug which is screwed into the end face on the high pressure side and closes off an assembly duct which receives the outlet valve.

As a result of the configuration according to the present invention, it is no longer necessary to use a capsule or other intermediate piece for once again reducing the diameter expansion necessary for the assembly of the outlet valve, so that the high pressure fitting can be mounted. It is also not necessary to extend the upper part in a corresponding manner. Rather, the outlet duct extends laterally of the assembly direction of the outlet valve toward the outside, so that the assembly opening for the outlet valve and the outlet duct can be shaped independently of each other. Moreover, sufficient structural space is available in the circumferential wall and the area of the upper part adjacent the circumferential wall, so that it is also possible to provide a fastening geometry for a high pressure fitting without having to enlarge the pressure amplifier more than is required for the structural size of the lower part, the middle part and the upper part.

In the alternative configuration it is also not necessary to provide a capsule or other intermediate piece in order to provide a transition between the bore in which the outlet valve is mounted and the outlet duct. A connecting plug is simply screwed into the end face on the high pressure side, wherein the connecting plug closes the bore receiving the outlet valve. The outlet duct can be accommodated in this connecting plug, while a connection geometry for a conventional high pressure fitting can also be accommodated. The connecting plug protrudes only by a short distance beyond the end face on the high pressure side, i.e., the connecting plug does not significantly extend the length of the housing. The plug is significantly shorter than the capsule which has been used in the past or the cover plate which has been used in the past; accordingly, the plug reduces the weight significantly.

In accordance with a preferred embodiment, the outlet duct branches off from an assembly duct starting from the end face on the high pressure side, wherein the outlet valve is arranged in the assembly duct and the assembly duct is closed by a closing plug. This significantly simplifies the construction of the pressure amplifier. The assembly duct for the outlet valve may extend from the end face of the housing without requiring additional measures. It is merely necessary to provide a lateral bore for manufacturing the outlet duct. The assembly duct for the outlet valve can be closed by the closing plug so that it is not necessary to partially disassemble the pressure amplifier when a high pressure fitting is connected. Accordingly, the outlet valve remains reliably mounted in the housing.

The closing plug preferably includes an adapter for a pressure sensor. The pressure sensor may also be mounted directly in the closing plug. This makes it possible in a simple manner to monitor the operation of the pressure amplifier. If necessary, the pressure sensor can also be used for controlling the pressure amplifier.

The outlet duct preferably has in the area of its outer end a diameter expansion. This diameter expansion can be used for screwing in a high pressure fitting. The outer end is located in the circumferential wall or in the end face of the connecting plug.

A relief duct preferably branches off in the area of the inner end of the diameter expansion. The diameter expansion usually has a connection geometry which serves for fastening the high pressure fitting. This connection geometry is usually configured as an internal thread into which an external thread of the high pressure fitting is screwed. As a result, a connecting surface of the high pressure fitting is placed against the bottom of the diameter expansion and, thus, secures a transfer to the outlet duct in the high pressure fitting. However, in some cases, this does not result in a completely tight seal, so that some liquid may merge at this location. The liquid can flow to the outside through the relief duct, so that the thread which serves for fastening the high pressure fitting is not subjected to a hydraulic pressure which is too high.

The outlet valve is preferably constructed as a check valve with a valve element which is movable in a direction perpendicularly of the end face. An amplifying piston of the pressure amplifier also moves in the same direction. Consequently, the essential elements of the pressure amplifier move in the same direction. This essentially limits any vibration excitation to one direction. The inner construction of the pressure amplifier can then remain essentially unchanged.

The housing preferably has a lower part on the low pressure side, an upper part on the high pressure side and a middle part therebetween. Such a configuration has been found useful in practice. The housing only requires three principal components.

Preferably, at least one of the parts lower part, middle part and upper part is cylindrically shaped. This facilitates the manipulation.

The outlet duct preferably opens into the circumferential wall at a distance from the end face on the high pressure side which is greater than the distance of the outlet valve from this end face. This utilizes the available structural space very well. For example, it is then possible to make available sufficient material in the circumferential wall for fastening the high pressure fitting.

Preferably, several outlet ducts distributed in circumferential direction open into the circumferential wall. It is then possible to close off the outlet ducts which are not required by means of suitable closing plugs, so that the flexibility in using the pressure amplifier is increased.

It is also advantageous if the housing is flattened in the area of the end of the outlet duct. This facilitates the assembly. It is then possible to easily place and screw in a fitting. The manufacture of a bore which later forms the outlet duct is then also made easier.

The connecting plug preferably has a greater diameter than the outlet valve and rests with its inner end face against a sealing surface in the housing. As a result, the seal between the connecting plug and the housing is located in an area which is located outside of the pair of threads between the connecting plug and the housing. Since the end face, if necessary with the intermediate arrangement of a sealing ring, can be pressed with a sufficiently high force against the sealing surface, a tight connection between the connecting plug and the housing can be ensured with sufficient reliability.

The various features of novelty which characterize the invention are pointed out with particularity in the claims annexed to and forming a part of the disclosure. For a better understanding of the invention, its operating advantages, specific objects attained by its use, reference should be had to the drawing and descriptive matter in which there are illustrated and described preferred embodiments of the invention.

DETAILED DESCRIPTION OF THE PREFERRED EMBODIMENTS

Figure 1:
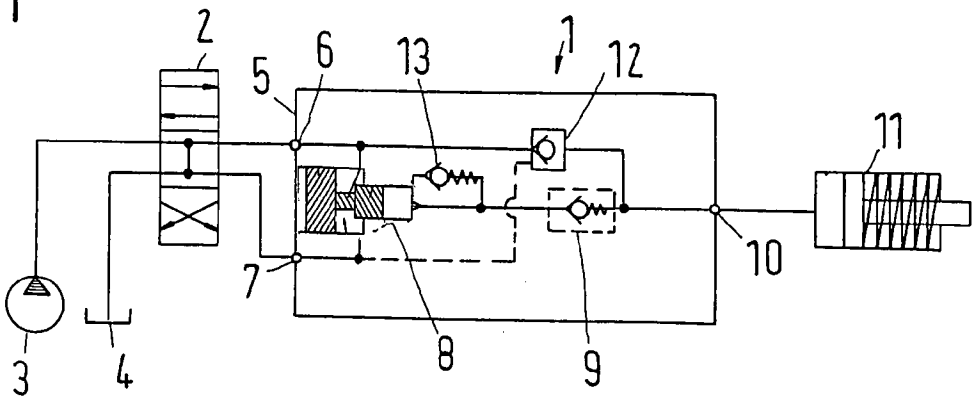
FIG. 1 is a schematic illustration of a hydraulic pressure amplifier.
Figure 3:
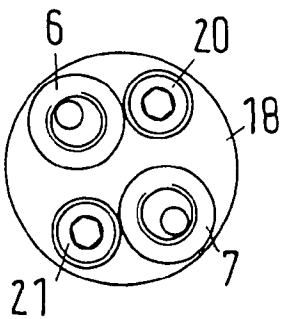
FIG. 3 is an end view of the low pressure side.

A pressure amplifier 1 for hydraulic liquid schematically illustrated in FIG. 1 is connected through a switching valve 2 to a pressure source 3, for example, a pump, and to a tank 4. The switching valve is connected to a low pressure side 5 which has a low pressure inlet 6 and a low pressure outlet 7.

The low pressure inlet 6 is connected to an amplifier 8 which usually is constructed as a stepped piston. The amplifier 8 is connected through an outlet valve 9 to a high pressure outlet 10 which, in turn, is connected to a schematically illustrated user 11.

In the illustrated embodiment, the pressure amplifier 1 additionally includes a discharge valve 12 which can be regulated through the low pressure outlet 7, and a control valve 13 constructed as a check valve, as is known in the art.

Figure 2:
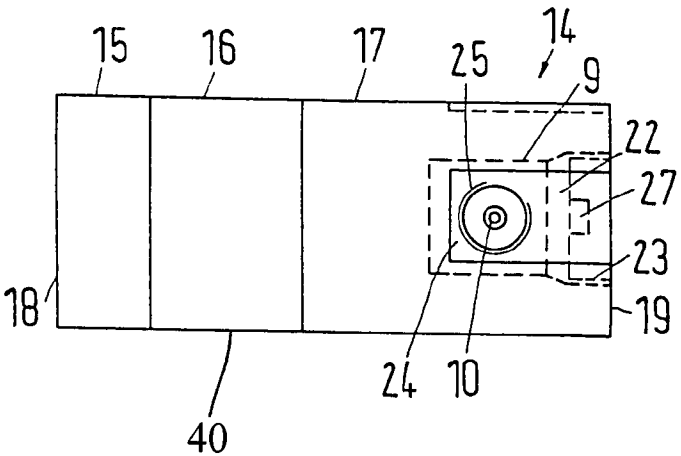
FIG. 2 is a side view of the hydraulic pressure amplifier.
Figure 4:
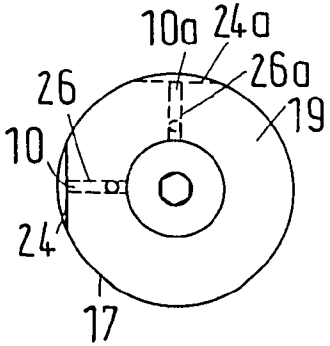
FIG. 4 is an end view of the high pressure side.

The functional elements of the pressure amplifier 1, i.e., the amplifier 8, the outlet valve 9, the discharge valve 12 and the control valve 13, are accommodated in a housing 14 which has a lower part 15, a middle part 16 and an upper part 17, as illustrated in FIG. 2. FIG. 2 merely is a schematic illustration and is not to be understood as being on scale. The lower part 15 has an end face 18 on a low pressure side and the upper part 17 has an end face 19 on a high pressure side. The housing 14 is otherwise essentially cylindrical and formed by a circumferential wall 40.

Arranged in the end face 18 on the low pressure side are the low pressure inlet 6 and the low pressure outlet 7. Additionally extending through the lower part 15 are threaded bolts 20, 21 which hold the lower part 15, the middle part 16 and the upper part 17 together in the axial direction.

Arranged in the upper part 17 is the outlet valve 9 which is placed in an assembly duct 22 which is closed off by a closing plug 23. As illustrated in FIG. 1, the outlet valve 9 is constructed as a check valve. The valve has a relatively large diameter of, for example, 10 mm. The assembly duct 22 also requires an appropriately large diameter.

The high pressure outlet 10, on the other hand, should have a significantly smaller diameter of, for example, 2 or 3 mm. Consequently, the high pressure outlet 10 extends to the circumferential wall through a high pressure duct 26 which branches off from the assembly duct 22. The upper part 17 has a flattened portion 24 in the area of the high pressure outlet 10. The high pressure outlet 10 has a diameter expansion 25 into which can be placed a high pressure fitting, not illustrated in detail.

It can be seen that the high pressure outlet 10 opens into the circumferential wall of the upper part 17 at a distance from the end face 19 on the high pressure side which is greater than the distance of the end of the outlet valve 9 from this end face 19 on the high pressure side. In this case, the high pressure outlet 10 could be connected, for example, to the assembly duct 22 through an inclined bore. However, the outlet valve 9 can also end at the same distance from the end face 19 on the high pressure side where the high pressure outlet 10 also opens into the circumferential surface of the housing 4.

As illustrated in broken lines, the upper part 17 may additionally have a second flattened portion **24*a* into which opens a second high pressure outlet 10*a* which is connected to the assembly duct 22 through a second high pressure duct 26*a***.

All parts which move within the housing, i.e., the valve elements of outlet valve 9, outlet valve 12 and control valve 13 as well as the stepped piston of the amplifier 8 move in the same direction, namely in the longitudinal or axial direction of the housing 14.

The high pressure outlets 10, **10*a*** which are not required at a given time can be closed in a simple manner by closing plugs, not illustrated.

The closing plug 23 may also have an adaptor for a pressure sensor 17 or the pressure sensor 27 itself. This makes it possible to monitor the operation of the pressure amplifier 1, particularly with respect to the desired or required pressure build-up.

Figure 5:
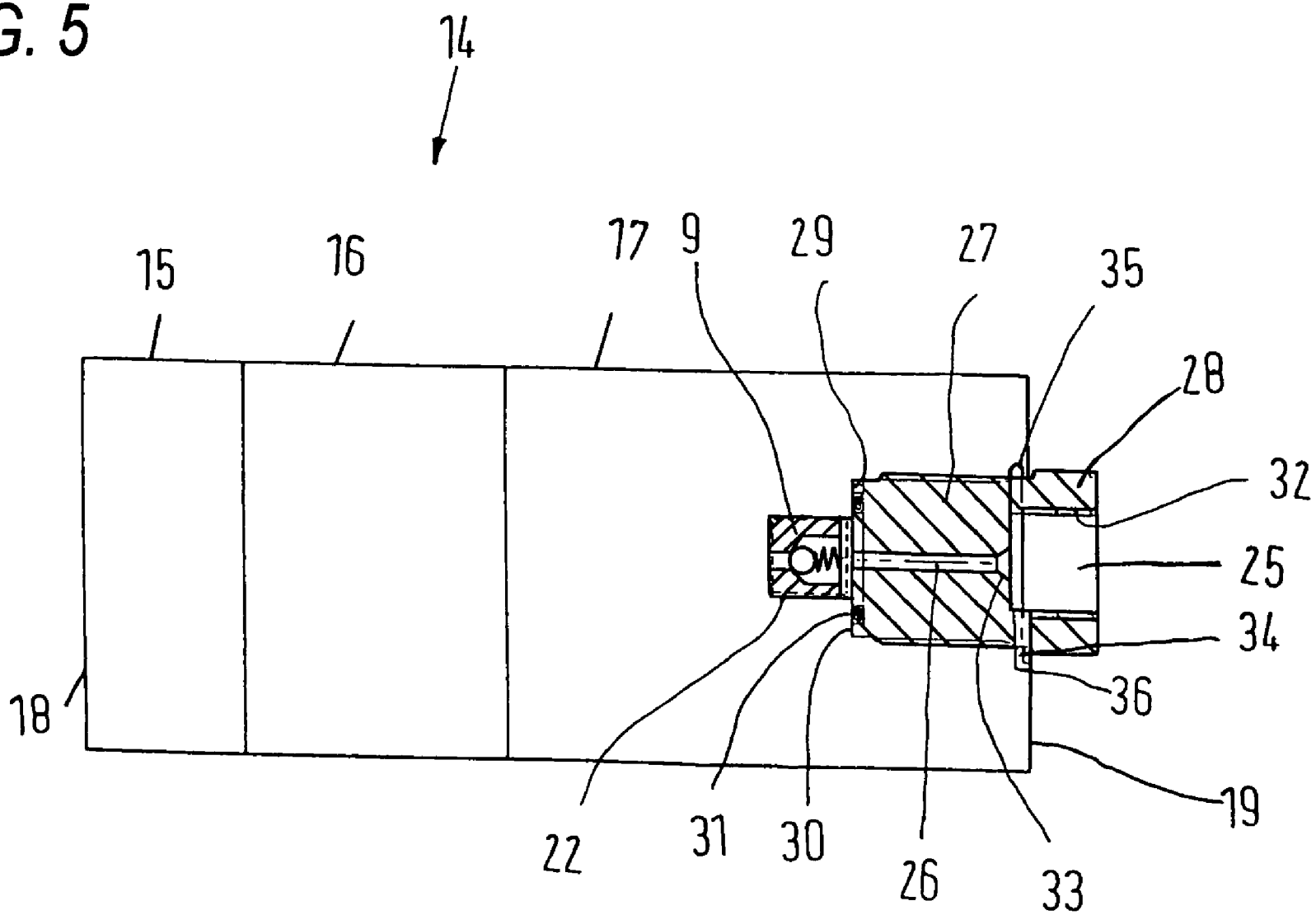
FIG. 5 is a schematic view showing an embodiment which is modified as compared to FIG. 2.

FIG. 5 shows an embodiment which is modified compared to the embodiment of FIG. 2. FIG. 5 shows the embodiment partially in a sectional view, wherein the same and equivalent elements are provided with the same reference numerals as in FIGS. 1 through 4.

In the embodiment of FIG. 5, a connecting plug 27 is screwed into the end face 19 on the high pressure side. The connecting plug protrudes with a section 28 from the upper part 27 of the housing 14.

The connecting plug 27 has a diameter which is greater than the diameter of the outlet valve 9 and, thus, also of the assembly duct 22 in which the outlet valve 9 is arranged.

In this manner, it is possible to have the connecting plug 27 with its inner end face 29 rest against a sealing surface 20 of the housing 14, or more specifically the upper part 17, which surrounds the assembly duct 22. In order to improve the sealing effect, an O-ring 31 is arranged in the inner end face 29 of the connecting plug 27, wherein the O-ring ensures the improved sealing action.

The high pressure duct 26 which forms the outlet duct extends through the connecting plug 27. The high pressure duct has the diameter expansion 25 which is provided with an internal thread 32, so that a high pressure fitting can be screwed in.

The high pressure duct 26 has a conical connection geometry 33 into which the high pressure fitting can be placed with a corresponding conical counter surface. The high pressure fitting has, in a conventional but not illustrated manner, a high pressure duct whose diameter corresponds approximately to that of the high pressure duct 26.

Provided at the inner end of the diameter expansion 25 is a relief duct 34 which opens toward the circumferential surface of the connecting plug 27. Provided at this location on the housing is an annular duct 35 which is in communication through a relief opening 36 in the end face 19 with the ambient surroundings. In the case of a small leakage, the relief duct 34, the annular duct 35 and the relief opening 36 prevent an unduly high pressure from acting on the pair of threads with the internal thread 32 and a corresponding external thread at the high pressure fitting.

Consequently, the alternative embodiment of FIG. 5 also requires relatively little structural space. The embodiment only needs three principal components of the housing, wherein the connecting plug 27 has two purposes. On the one hand, the connecting plug 27 closes off the assembly duct 22 for the outlet valve 9. On the other hand, the plug 27 serves as means for keeping the diameter of the high pressure duct 25 small and simultaneously for making available a connecting geometry for the high pressure fitting.

While specific embodiments of the invention have been shown and described in detail to illustrate the inventive principles, it will be understood that the invention may be embodied otherwise without departing from such principles.

We claim:

1. A hydraulic pressure amplifier comprising a housing having an end face on a low pressure side and an end face on a high pressure side and a circumferential wall between the end faces, an outlet valve arranged adjacent the end face on the high pressures side, and an outlet duct for hydraulic liquid which is under high pressure, wherein the outlet duct opens into the circumferential wall or extends through a connecting plug screwed into the end face on the high pressure side and closing off an assembly duct in which the outlet valve is received.

2. The pressure amplifier according to claim 1, wherein the outlet duct has in an area of an outer end thereof a diameter expansion.

3. The pressure amplifier according to claim 2, wherein a relief path branches off in an area of an inner end of the diameter expansion.

4. The pressure amplifier according to claim 1, wherein the housing has a lower part on the low pressure side, an upper part on the high pressure side and a middle part between the lower and upper parts.

5. The pressure amplifier according to claim 4, wherein at least one of the components lower part, middle part and upper part is cylindrical.

6. The pressure amplifier according to claim 1, wherein the outlet valve is a check valve having a valve element which is movable in a direction perpendicularly of the end face.

7. The pressure amplifier according to claim 1, wherein the outlet duct opens into the circumferential wall at a distance from the end face on the high pressure side which is greater than a distance of the outlet valve from this end face.

8. The pressure amplifier according to claim 1, comprising a plurality of outlet ducts distributed in a circumferential direction and opening into the circumferential wall.

9. The pressure amplifier according to claim 1, wherein the housing has a flattened portion in an area of the opening of the outlet duct.

10. The pressure amplifier according to claim 1, wherein the connecting plug has a diameter which is greater than that of the outlet valve, and wherein the connecting plug rests with an inner end face thereof against a sealing surface of the housing.

11. A hydraulic pressure amplifier comprising a housing having an end face on a low pressure side and an end face on a high pressure side and a circumferential wall between the end faces, an outlet valve arranged adjacent the end face on the high pressures side, and an outlet duct for hydraulic liquid which is under high pressure, wherein the outlet duct opens into the circumferential wall or extends through a connecting plug screwed into the end face on the high pressure side and closing off an assembly duct in which the outlet valve is received, wherein the outlet duct is branched off from the assembly duct which extends from the end face on the high pressure side, wherein the outlet valve is arranged in the assembly duct and wherein the assembly duct is closed by a closing plug.

12. The pressure amplifier according to claim 11, wherein the closing plug comprises an adapter for a pressure sensor.

* * * * *